US006585302B2

(12) United States Patent
Lin

(10) Patent No.: US 6,585,302 B2
(45) Date of Patent: Jul. 1, 2003

(54) ELECTRICALLY OPERATED LOCK

(75) Inventor: Chen-Ming Lin, Chiayi (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 0 days.

(21) Appl. No.: 10/035,624

(22) Filed: Oct. 23, 2001

(65) Prior Publication Data

US 2002/0084656 A1 Jul. 4, 2002

(30) Foreign Application Priority Data

Oct. 23, 2000 (TW) ..... 89218424 U

(51) Int. Cl.[7] ..... E05C 1/06

(52) U.S. Cl. ..... 292/142; 292/39; 292/144; 70/257; 70/280

(58) Field of Search ..... 292/142, 144, 292/39; 70/275, 277, 280, 281, 282, 257

(56) References Cited

U.S. PATENT DOCUMENTS 4,843,851 A * 7/1989 Frolov ..... 70/277
4,887,442 A * 12/1989 Lavelle ..... 70/143
4,995,248 A * 2/1991 Liu ..... 70/107
5,027,629 A * 7/1991 Liu ..... 70/277
5,083,448 A * 1/1992 Kärkkäinen et al. ..... 70/277
5,199,288 A * 4/1993 Meriläinen et al. ..... 70/279
5,513,505 A * 5/1996 Dancs ..... 70/107
5,611,227 A * 3/1997 Solovieff ..... 70/472
5,857,365 A 1/1999 Armstrong
6,012,310 A * 1/2000 Hsiao ..... 70/278.2
6,062,612 A * 5/2000 Lin ..... 292/144
6,112,563 A * 9/2000 Ramos ..... 70/278.1
6,334,636 B1 * 1/2002 Huang et al. ..... 292/144
6,406,072 B1 * 6/2002 Chen ..... 292/144

* cited by examiner

*Primary Examiner*—William L. Miller
*Assistant Examiner*—Carlos Lugo
(74) *Attorney, Agent, or Firm*—Senniger, Powers, Leavitt & Roedel

(57) ABSTRACT

An electrically operated lock including a latch mechanism, a spindle for displacing a dead bolt of the latch mechanism, and an actuating unit which includes a swing member, a slider, a first cam mechanism, a wheel member, a second cam mechanism, and a motor for actuating the spindle. The swing member coacts with the spindle and swings along with rotation of the spindle. The slider coacts with the swing member and is movable between a first and a second position. The first cam mechanism coacts with the slider and the swing member so as to move the slider between the first and second positions in a manual operation mode. The wheel member coacts with the slider. The second cam mechanism coacts with the slider and the wheel member so as to move the slider between the first and second positions in an electrical operation mode.

4 Claims, 5 Drawing Sheets

ELECTRICALLY OPERATED LOCK

CROSS-REFERENCE TO RELATED APPLICATION

This application claims priority of Taiwan patent Application No. 89218424, filed on Oct. 23, 2000.

BACKGROUND OF THE INVENTION

1. Field of the Invention

This invention relates to a lock, more particularly to an electrically operated lock with a latch mechanism, which can be operated manually or electrically.

2. Description of the related art

U.S. Pat. No. 5,857,365 discloses a lock which includes a latch mechanism with a dead bolt that is movable between a retracted and an advanced position, a spindle coacting with the latch mechanism and tumable to displace the dead bolt between the retracted and advanced positions, a pinion sleeved on the spindle a slider formed with a vertical slot for passage of the spindle therethrough and provided with upper and lower controlled faces and a vertical rack which cooperates with the pinion, a wheel gear provided with a finger that is turnable along with the wheel gear to engage the upper and lower controlled faces so as to move the slider upwardly and downwardly and so as to turn the spindle via engagement between the pinion and the vertical rack, and a motor connected to the wheel gear via a gear mechanism that includes a worm gear unit coupling the motor and the wheel gear.

SUMMARY Of THE INVENTION

The object of the present invention is to provide an electrically operated lock with a latch mechanism that can be operated manually or electrically. Instead of using the aforesaid pinion and rack assembly in the aforementioned patent, the lock of this invention uses a cam mechanism to perform the function of the latch mechanism.

According to the present invention, the electrically operated lock comprises: a latch mechanism with a dead bolt that is movable in a lateral direction between a retracted and an advanced position; a spindle defining an axial direction that is transverse to the lateral direction, coacting with the latch mechanism, and turnable to displace the dead bolt between the retracted and advanced positions; and an actuating unit including a swing member, a slider, a first cam mechanism, a wheel member, a second cam mechanism, and a motor. The swing member coacts with the spindle and is swingable along with rotation of the spindle. The slider coacts with the swing member and is movable in a direction substantially parallel to the lateral direction between a first and a second position. The first cam mechanism has a first cam member that is provided on the slider, and a first cam follower that is provided on the swing member and that cooperates with the first cam member for moving the slider between the first and second positions. The wheel member coacts with the slider. The second cam mechanism has a second cam member that is provided on the slider, and a second cam follower that is provided on the wheel member and that cooperates with the second cam member for moving the slider between the first and second positions. The motor coacts with the wheel member for turning the wheel member.

BRIEF DESCRIPTION OF THE DRAWINGS

In drawings which illustrate an embodiment of the invention.

DETAILED DESCRIPTION OF THE PREFERRED EMBODIMENT

Figure 1:
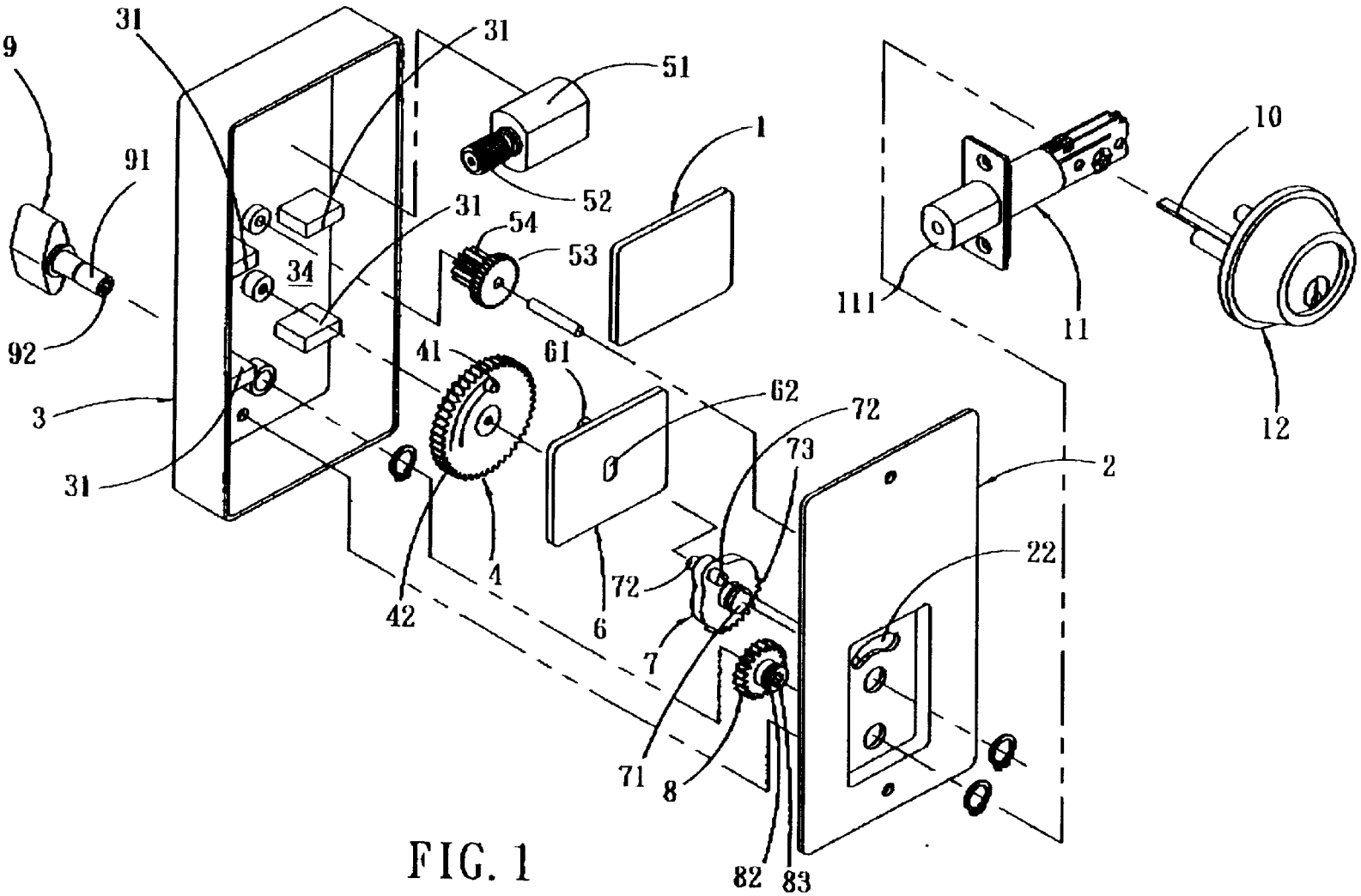
FIGS. 1 and 2 are exploded perspective views of an electrically operated lock embodying this invention.
Figures 2, 3:
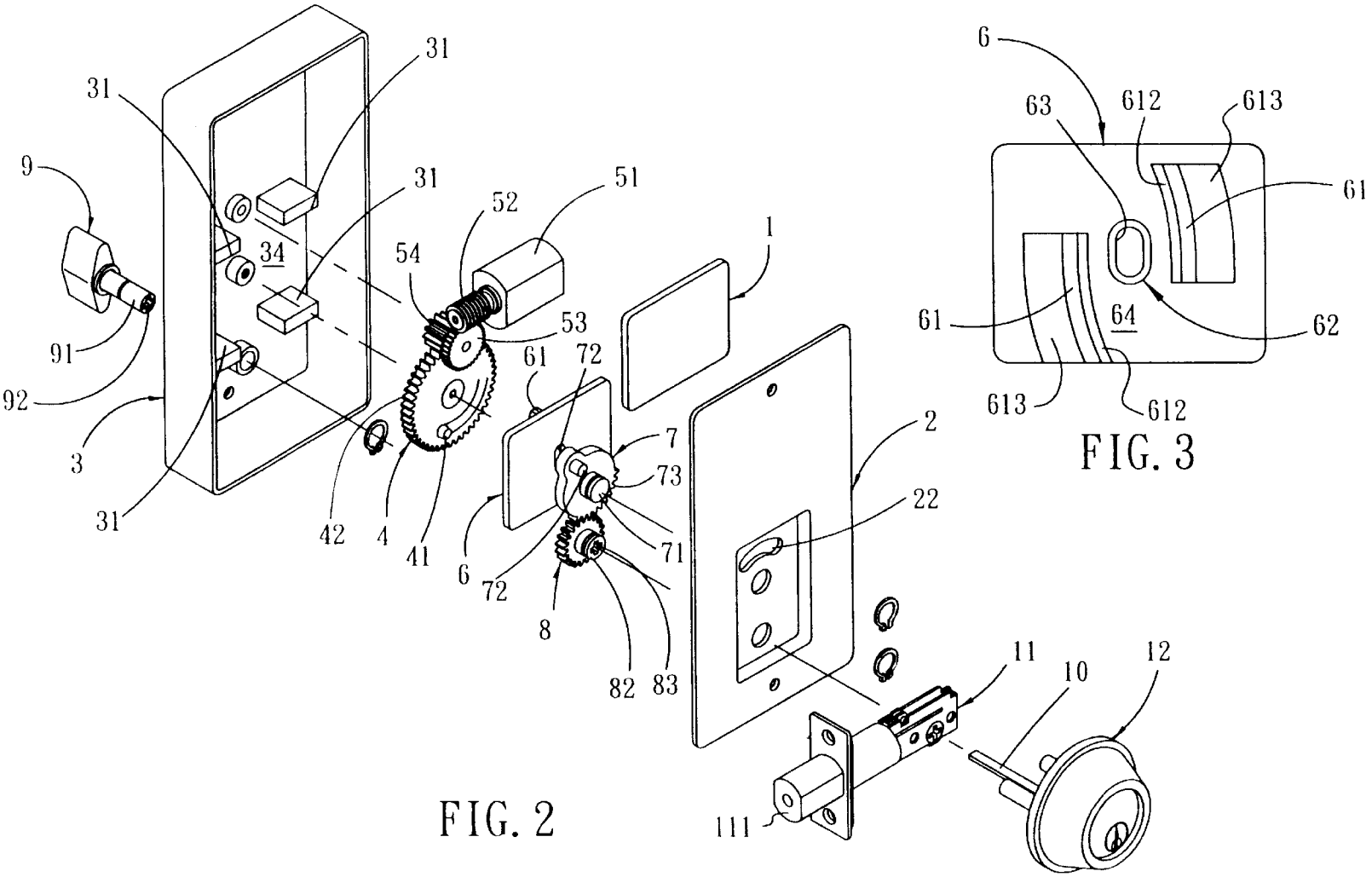
FIG. 3 is a rear view of a slider of the electrically operated lock of FIG. 1.

FIGS. 1 to 5 illustrate an electrically operated lock embodying this invention.

The lock includes: an inner lock housing 3 with a front cover plate 2; an outer lock housing 12 disposed adjacent to the front cover plate 2; a latch mechanism 11 disposed between the outer lock housing 12 and the front cover plate 2 and having a dead bolt 111 that is movable in a lateral direction between a retracted and an advanced position; a spindle 10 extending axially from the outer lock housing 12 towards the inner lock housing 3 defining an axial direction that is transverse to the lateral direction, coacting with the latch mechanism 11 and turnable to displace the dead bolt 111 between the retracted and advanced positions; and an actuating unit disposed in the inner lock housing 3.

In this invention, the actuating unit includes: a swing member 7, a slider 6, a first cam mechanism (described later), a wheel member 4, a second cam mechanism (described later), and a motor 51 for turning the spindle 10 to actuate the latch mechanism 11.

In the illustrated embodiment, the inner lock housing 3 includes four retaining plates 31 projecting in a direction substantially parallel to the axial direction from a rear wall towards the front cover plate 2 for confining a slider moving space 34 among the retaining plates 31. The front cover plate 2 is formed with an arcuate slot 22.

The slider 6 is disposed between the swing member 7 and the wheel member 4 within the slider moving space 34.

The swing member 7 coacts with the spindle 10 via a first gear mechanism, and has a pivotal stud 71 mounted pivotally on the front cover plate 2.

To couple the spindle 10 and the swing member 7, the first gear mechanism has a first gear part 8 that is sleeved securely on the spindle 10, and a second gear part 73 that is formed on a bottom of the swing member 7 for meshing with the first gear part 8. The first gear part 8 has a pivotal stud 82 projecting therefrom towards the front cover plate 2 and mounted pivotally on the front cover plate 2 and formed with a cross-shaped retaining hole 83. The spindle 10 is fittingly received in the retaining hole 83 in the pivotal stud 82.

The first cam mechanism may further include a first cam member defined by a cam hole 62 formed on the slider 6 for confining a camming face 53, and a first cam follower 72 provided on the swing member 7 and projecting in a direction substantially parallel to the axial direction to engage the cam hole 62 to engage the camming face 63, so as to cooperate with the cam hole 62 of the first cam member for moving the slider 6 between the first and second positions in a manual operation mode and for moving the swing member 7 between the first and second angular positions in an electronic operation mode. The first cam follower 72 is in the form of a rod, and extends from the swing member 7 towards the front cover plate 2 into the arcuate slot 22 to expose out of the front cover plate 2.

Figure 5:
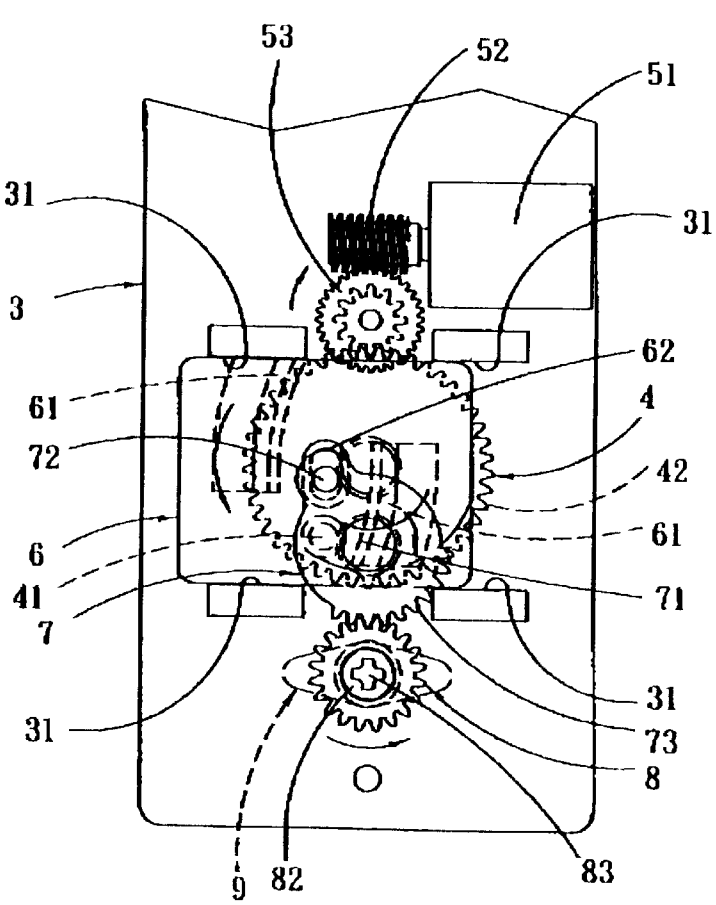
FIG. 5 is a schematic front view showing the slider of the lock of FIG. 1, at a left position during the left-swing door operation mode.
Figure 4:
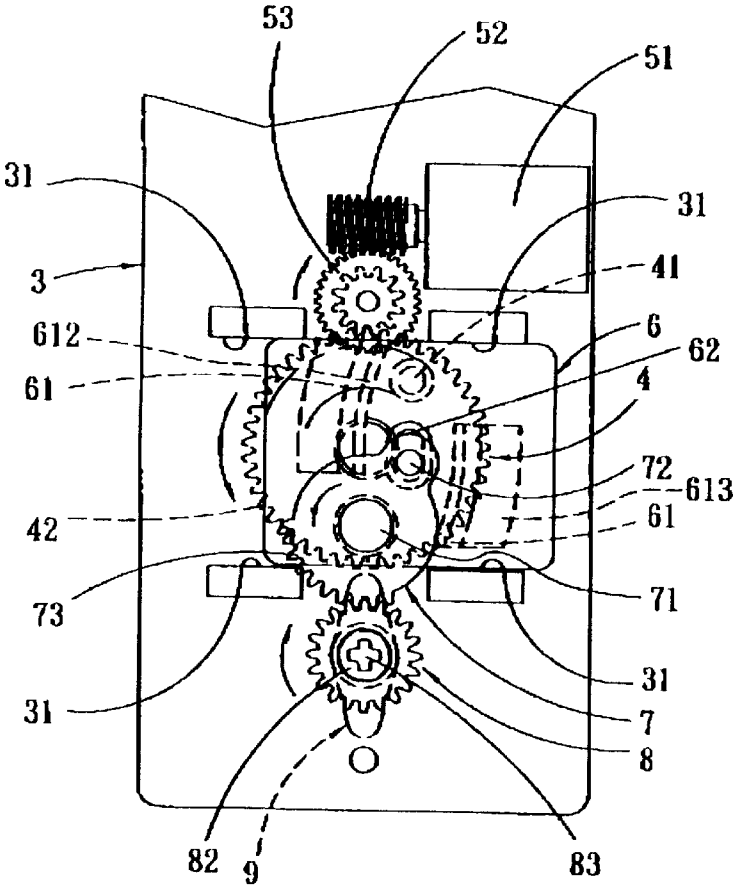
FIG. 4 is a schematic front view showing the slider of the lock of FIG. 1, at a right position during a left-swing door operation mode.
Figure 7:
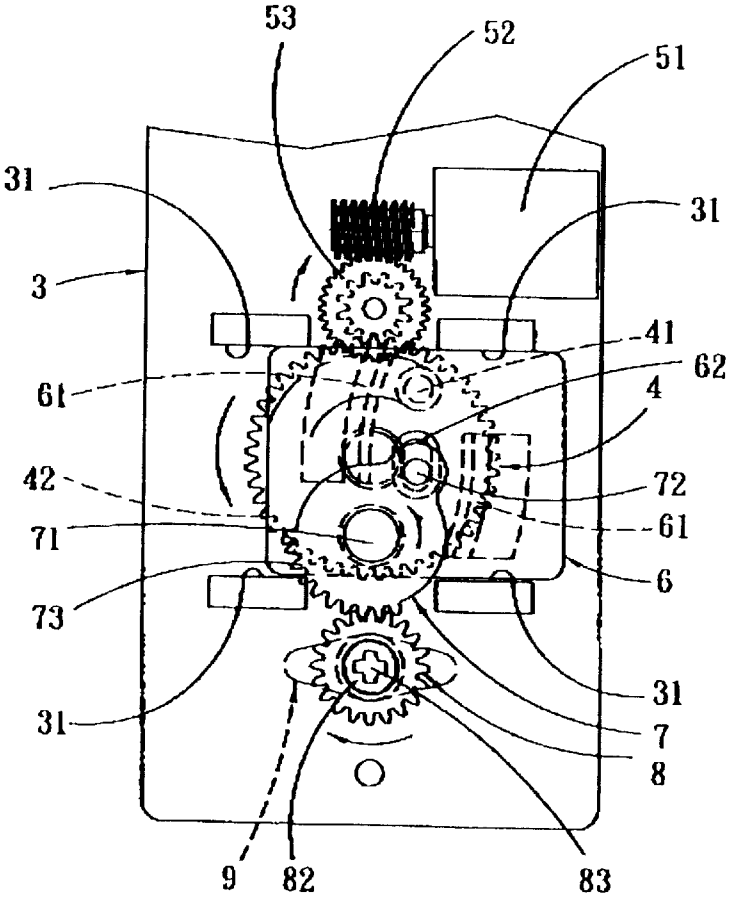
FIG. 7 is a schematic front view showing the slider of the lock of FIG. 1, at a right position during a right-swing door operation mode.
Figure 6:
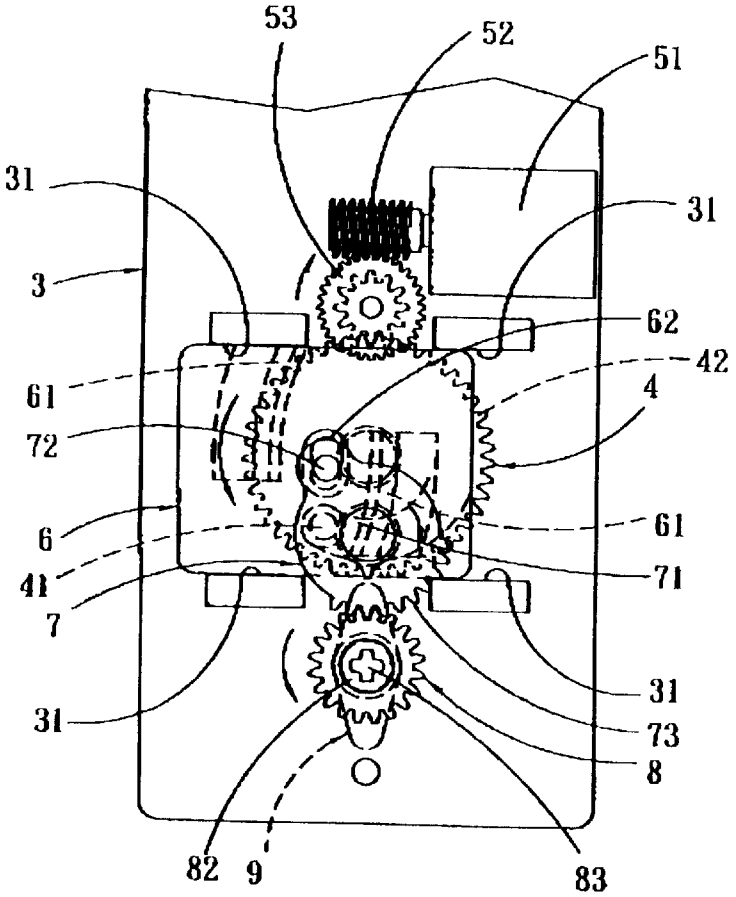
FIG. 6 is a schematic front view showing the slider of the lock of FIG. 1, at a left position during a right-swing door operation mode.
Figure 8:
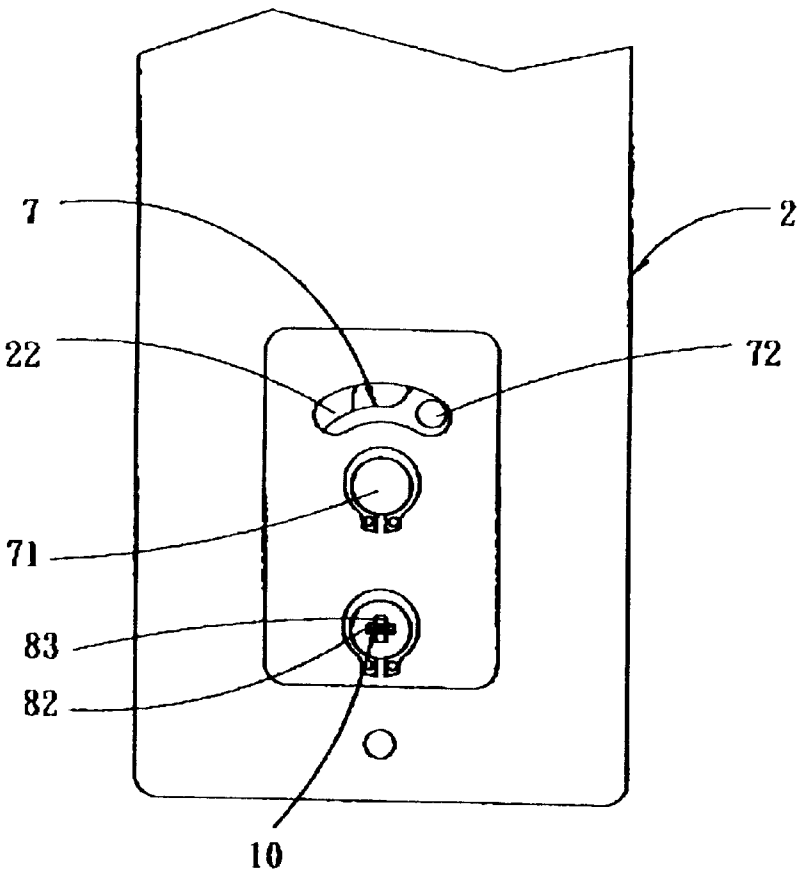
FIG. 8 is a schematic front view showing a swing member of the lock of FIG. 1, at a first angular position during a left-swing door operation mode.

As such, the swing member 7 is swingable along with rotation of the spindle 10 between a first and a second angular position, such as that shown in FIGS. 4 and 5 for a left-swing door operation mode, and FIGS. 6 and 7 for a right-swing door operation mode. To adapt the electrically operated lock to a left-swing door, prior to assembling the electrically operated lock to the door, the first cam follower 72 is manipulated through the arcuate slot 22, to the position shown in FIG. 8, which corresponds to FIG. 4 to illustrate the position of the swing member 7 during the left-swing door operation mode viewed from a front side of the front cover plate 2.

Figure 9:
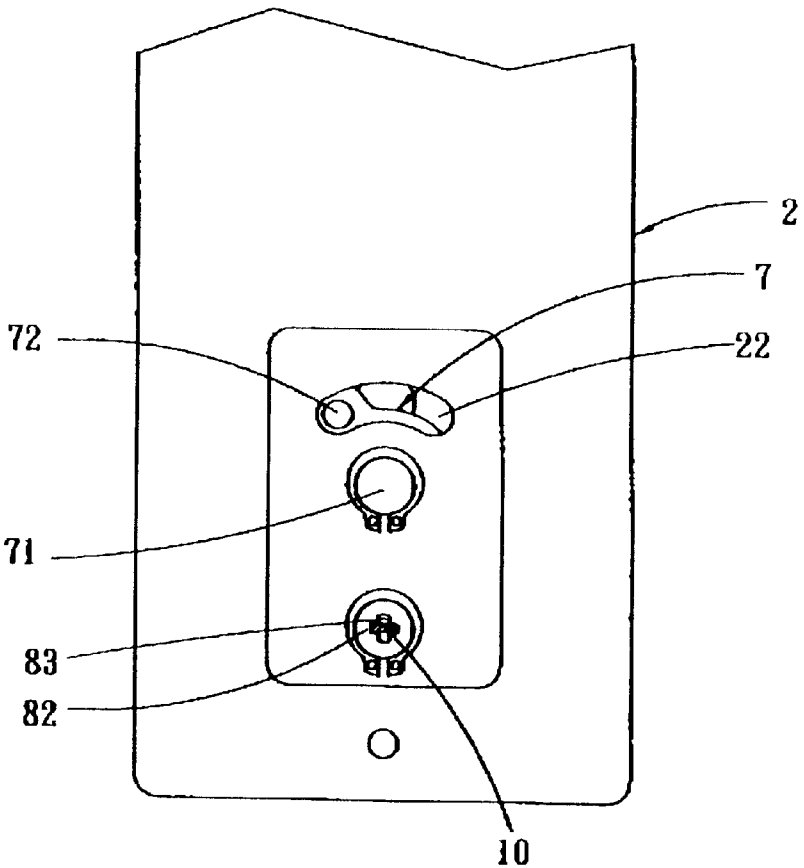
FIG. 9 is a schematic front view showing the swing member of the lock of FIG. 1, at a second angular position during a rightswing door operation mode.

On the contrary, to adapt the electrically operated lock to a right-swing door, prior to assembling the electrically operated lock to the door, the first cam follower 72 is manipulated through the arcuate slot 22, to the position shown in FIG. 9, which corresponds to FIG. 6 to illustrate the position of the swing member 7 during the right-swing door operation mode viewed from a front side of the front cover plate 2.

Movement of the slider 6 subjects the wheel member 4 to turn via the second cam mechanism. The second cam mechanism includes: a second cam member defined by two opposing curved ribs 61 having camming faces 612, 613 on both sides and projecting in a direction substantially parallel to the axial direction toward the wheel member 4 for confining a cam moving space 64 therebetween, and a second cam follower 41, preferably made of an elastic material allowing slight movement of the second cam follower 41 in a direction substantially parallel to the axial direction, the second cam follower 41 being provided on the wheel member 4 to cooperate with one of the curved ribs 61 for moving the slider 6 between the first and second positions under the electronic operation mode. The second cam follower 41 projects in a direction substantially parallel to the axial direction into the cam moving space 64 to engage one of the curved ribs 61 Preferably, the cam hole 62 is disposed at a center position between the curved ribs 61.

The wheel member 4 is driven to turn by the motor 51 via a second gear mechanism. The second gear mechanism includes a worm gear unit that has a worm output 52 coacting with a driving shaft of the motor 51, and a worm gear 53. The second gear mechanism may further includes a third gear part 42 that is formed on the wheel member 4, and a fourth gear part 54 that is formed on the worm gear 53 of the worm gear unit and that meshes with the third gear part 42.

A knob 9 has a shaft portion 91 that extends towards the front cover plate 2 through the rear wall of the inner lock housing 3 toward a rear side of the first gear part 8 and that is formed with a cross-shaped retaining hole 92. The spindle 10 extends through the latch mechanism 11 and then through the pivotal stud 82 of the first gear part 8, and is received fittingly in the retaining hole 92 on the shaft portion 91 of the knob 9.

Two micro-switches (not shown) are disposed in the inner lock housing 3, to coact with the slider 6, and are electrically connected to a controller 1 so as to detect the slider 6 position and so as to control movement of the dead bolt 111 between the retracted and advanced positions via the actuating unit.

In the manual operation mode, turning of the knob 9 results in swinging movement of the swing member 7 and rotation of the spindle 10, which, in turn, results in movement of the slider 6 between the first and second positions and displacement of the dead bolt 111 between the retracted and advanced positions. Depending on the state of the motor 51, the wheel member 4 is not necessarily activated by the slider 6 if the motor 51 prevents so, due to the interaction between the second cam follower 41 of the wheel member 4 and one of the camming faces 612, 613 of the curved ribs 61, as adopted In U.S. Pat. No. 5,857,365.

In the electronic operation mode, the motor 51 is actuated by the controller 1 upon receiving a signal to turn the wheel member 4, which, in turn, results in movement of the slider 6 between the first and second positions and movement of the swing member 7 between the first and second angular positions, thereby displacing the dead bolt 111 between the retracted and advanced positions.

With the invention thus explained, it is apparent that various modifications and variations can be made without departing from the spirit of the present Invention. It is therefore intended that the invention be limited only as recited in the appended claims.

Sequence Listing of Elements

1 controller
2 front cover plate
3 inner lock housing
4 wheel member
6 slider
7 swing member
8 first gear part
9 knob
10 spindle
11 latch mechanism
12 outer lock housing
22 arcuate slot
31 retaining plates
34 slider moving space
41 second cam follower
42 third gear part
51 motor
52 worm output
53 worm gear
54 fourth gear part
61 curved ribs
62 cam hole
63 camming face
64 cam moving space
71 pivot stud
72 first cam follower
73 second gear part
82 pivotal stud
83 retaining hole
91 shaft portion
92 retaining hole
111 dead bolt
612 camming face
613 camming face

What is claimed is:

1. An electrically operated lock comprising:

a latch mechanism with a dead bolt that is movable in a lateral direction between a retracted and an advanced position;

a spindle defining an axial direction that is transverse to said lateral direction, coacting with said latch mechanism, and turnable to displace said dead bolt between said retracted and advanced positions; and an actuating unit including:

a swing member coacting with said spindle and swingable along with rotation of the spindle, a slider coacting with said swing member and movable in a direction substantially parallel to said lateral direction between a first and a second position, a first cam mechanism having a first cam member that is provided on said slider, and a first cam follower that is provided on said swing member and cooperates with said first cam member for moving said slider between said first and second positions, a wheel member selectively coacting with said slider, a second cam mechanism having: a second cam member that is provided on said slider, and a second cam follower that is provided on said wheel member and cooperates with said second cam member for moving said slider between said first and second positions;

a motor coacting with said wheel member for turning said wheel member;

said slider is disposed between said swing member and said wheel member;

said first cam member is defined by a camming face formed on the slider;

said second cam member is defined by two opposing curved ribs projecting in a direction substantially parallel to said axial direction of said spindle toward said wheel member, said two curved ribs confining a cam moving space therebetween, said camming face being disposed at a center position between said curved ribs; and said first cam follower projecting in a direction substantially parallel to said axial direction of said spindle to engage said camming face, said second cam follower projecting in a direction substantially parallel to said axial direction into said cam moving space to engage one of said curved ribs.

2. The electrically operated lock of claim 1, further comprising:

a first gear mechanism coupling said spindle and said swing member, the first gear mechanism including:

a first gear part that is sleeved securely on said spindle; and a second gear part that is formed on a bottom of said swing member for meshing with said first gear part.

3. The electrically operated lock of claim 2, further comprising:

a second gear mechanism coupling said wheel member and said motor, the second gear mechanism including:

a worm gear unit that coacts with said motor;

a third gear part that is formed on said wheel member; and a fourth gear part that is formed on said worm gear unit for meshing with said third gear part.

4. The electrically operated lock of claim 3, further comprising:

a front cover plate formed with a slot, the first cam follower passing through the slot to allow manual manipulation of the first cam follower.

* * * * *

UNITED STATES PATENT AND TRADEMARK OFFICE

CERTIFICATE OF CORRECTION

PATENT NO. : 6,585,302 B2
APPLICATION NO. : 10/035624
DATED : July 1, 2003
INVENTOR(S) : Chen-Ming Lin It is certified that error appears in the above-identified patent and that said Letters Patent is hereby corrected as shown below:

CORRECT TITLE PAGE (73) TO READ:
(73) Assignee: Tong Lung Metal Industry Co., Ltd.

Signed and Sealed this

Twenty-eighth Day of November, 2006

JON W. DUDAS
*Director of the United States Patent and Trademark Office*